United States Patent [19]

Sesoko

[11] 4,127,083

[45] Nov. 28, 1978

[54] DEVELOPER SEALING DEVICE FOR XEROGRAPHIC COPYING MACHINE

[75] Inventor: Shinichi Sesoko, Ebina, Japan

[73] Assignee: Fuji Xerox Co., Ltd., Tokyo, Japan

[21] Appl. No.: 852,639

[22] Filed: Nov. 18, 1977

[30] Foreign Application Priority Data

Jan. 27, 1977 [JP] Japan ..... 52/7237

[51] Int. Cl.[2] ..... G03G 21/00

[52] U.S. Cl. ..... 118/653; 355/15

[58] Field of Search ..... 118/652, 653; 355/15

[56] References Cited

U.S. PATENT DOCUMENTS

| | | | |
|---|---|---|---|
| 3,566,786 | 3/1971 | Kaufer | 118/653 |
| 3,660,863 | 5/1972 | Gerbasi | 355/15 |
| 3,848,992 | 11/1974 | Smith | 355/15 |
| 3,941,469 | 3/1976 | Okamoto | 118/653 |

*Primary Examiner*—Robert I. Smith

*Attorney, Agent, or Firm*—Sughrue, Rothwell, Mion, Zinn and Macpeak

[57] ABSTRACT

A sealing device is provided for sealing the gap between a rotatable photosensitive member and the housing of a cleaning or developing unit. The sealing device is a membrane sealing member attached at one end to the housing. The other end of the sealing member resiliently contacts the periphery of the photosensitive member when the photosensitive member is at rest. The sealing member has a relatively shallow angle of contact measured from a line parallel to the tangent to the periphery of the photosensitive member and is sufficiently flexible that air entrained by the rotation of the photosensitive member causes the sealing member to be floated from the surface of the photosensitive member.

4 Claims, 7 Drawing Figures

DEVELOPER SEALING DEVICE FOR XEROGRAPHIC COPYING MACHINE

BACKGROUND OF THE INVENTION

This invention relates to a developer sealing device for a zerographic copying machine which device serves to provide a seal between a rotating photosensitive member and the end of the housing of a cleaning or developing unit.

A xerographic copying machine must be provided with means for sealing the gap between the cleaning unit or developing unit and the rotating photosensitive member for the purpose of preventing developer from being leaked out of the cleaning or developing unit. In the past, two arrangements have been used to provide the required seal. In one, the ends *a* of the cleaning unit or developing unit housing are positioned as near to the photosensitive member *b* as possible as shown in FIG. 1. In the other, films *c* are attached to the ends *a* of the housing and are in contact with the photosensitive member *b* as shown in FIG. 2.

In the first case, it has been found that when the ends *a* of the housing are sufficiently close to the photosensitive member *b* that a developer will not be leaked out from the developing unit, the ends *a* scratched the member *b* due to the eccentric displacement or the like of the member *b*. In the case of the second arrangement, the films *c* not only tear the photosensitive member *b* in long-term usage, but the films *c* when attached to the entrance of the cleaning unit scrape off the residual developer which should instead be scraped off in the cleaning unit or when attached to the exit of the developing unit sweep off the developed picture.

SUMMARY OF THE INVENTION

This invention contemplates the elimination of the aforementioned disadvantages and one object of this invention is to provide a developer sealing device for a xerographic copying machine which can position a membrane sealing member sufficiently close to the photosensitive member that the developer will not be leaked out preventing the photosensitive member from being scratched to enable long-period usage of the photosensitive member and also eliminating the difficulties in the conventional arrangement in which the films are provided at the entrance or exit of the cleaning unit or developing unit, respectively.

The foregoing and other objects of the invention are attained by providing a membrane sealing member which resiliently contacts the periphery of the photosensitive member when said photosensitive member is at rest. The sealing member is preferably made of a thin polyester film and has a relatively shallow angle of contact measured from a line parallel to the tangent to the periphery of the photosensitive member of between 15° to 30°. The sealing member is sufficiently long and flexible that air entrained by the rotation of photosensitive member causes the sealing member to be floated from the surface of the photosensitive member.

DETAILED DESCRIPTION OF THE INVENTION

Figure 1:
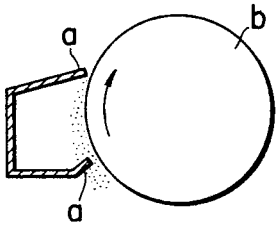
FIG. 1 PRIOR ART
FIGS. 1 and 2 are schematic structural views of the conventional developer sealing devices.
Figure 2:
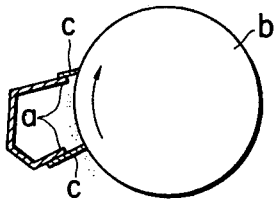
FIG. 2 PRIOR ART

In the several Figures, reference numeral 1 designates the drum-shaped photosensitive member, 2 a cleaning blade, 8 the housing of a cleaning unit A, 10 the housing of a developing unit B, and 7 a carrying unit, all of which are conventional and well known in the art.

Resilient membrane sealing members 6 of extremely thin insulating film are attached at one ends thereof to the ends of the housings 8 and 10 of the cleaning and developing units A and B, respectively, and resiliently contact at the other ends thereof the surface of the photosensitive member 1 to seal the developer in the cleaning and developing units A and B. The sealing members 6 have a resiliency sufficient to be floated by a small amount of air entrained by the rotation of the photosensitive member 1.

Figure 5:
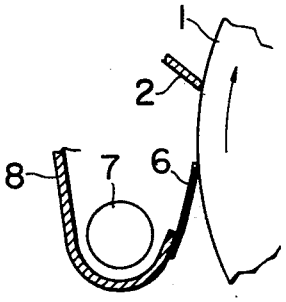
FIG. 5 is a detailed fragmentary view of the portion designated by V in FIG. 3.
Figure 6:
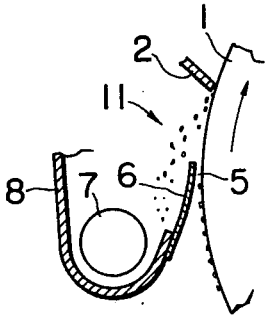
FIG. 6 is a detailed fragmentary view of the portion designated by VI in FIG. 4.

In the operation of the developer sealing device of this invention thus constructed, when the photosensitive member 1 is rotated, the membrane sealing member 6 is slightly floated from the surface of the photosensitive member 1 by means of the entrained airflow 5 caused by the rotation of the member 1 to produce a small gap between the surface of the photosensitive drum 1 and the membrane sealing member 6 as shown in FIG. 6. Therefore, the membrane sealing member 6 thus arranged serves to maintain the sealing function of the developer upon rotation of the photosensitive member 1 and yet will not scratch the surface of the photosensitive drum 1. When the sealing member 6 is used at the entrance $A_1$ of the cleaning unit A, residual developer 9 retained upon completion of a transferring operation to a copy sheet enters the cleaning unit without being scraped off by the membrane sealing member 6, as shown in FIGS. 5 and 6. The residual developer 9 enters the housing 8, the residual developer 11 scraped off by the cleaning blade 2 falls back into the housing 8 due to the entrained air stream 5 produced by the rotation of the photosensitive drum 1. Thus, not only does the entrained air stream permit very close positioning of the membrane 6 to the drum 1, it also causes the sealing effect of the developer at this portion to be further enhanced. When the sealing member 6 is used at the exit $B_1$ of the developing unit B the housing 10 is sealed by the entrained air stream 5 in the same manner as the case of the entrance $A_1$ of the cleaning unit A.

Figure 3:
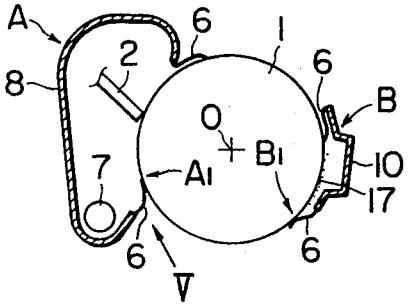
FIG. 3 is a schematic structural view at one preferred embodiment of the invention.
Figure 4:
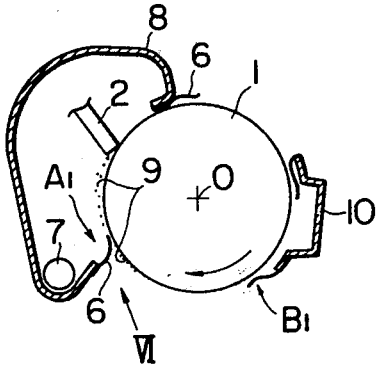
FIG. 4 is a view similar to FIG. 3 illustrating the sealing device of this invention during the rotation of the photosensitive member.

As shown in FIG. 3, when the photosensitive member 1 is stopped from rotation, the sealing member 6 contacts the surface of the photosensitive member 1 with the result that the entrance and exit $A_1$ and $B_1$ of the housings 8 and 10 of the cleaning and developing units A and B, respectively, are sealed to cause the developer to be prevented from being leaked out.

Figure 7:
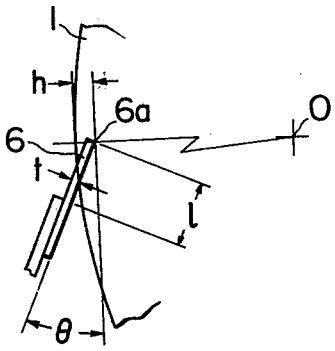
FIG. 7 is an explanatory view of the relative position and dimensions of the sealing member according to the invention.

The following example of numerical data of the arrangement of this invention has been found to provide the best results in operation. In FIG. 7, the depression depth *h* of the membrane sealing member 6 into the photosensitive member 1 from the surface of the member 1 is in the range of 2 to 4 mm. The angle $\theta$ formed between a normal line from the end 6a of the membrane sealing member 6 on a redius of the photosensitive member 1 and the sealing member 6 is in the range of 15° to 30°. The thickness $t$ of the membrane sealing member 6 of polyester film (such as Mylar, a trade name of E.I. du Pont de Nemours) is in the range of 5 to 20 microns, and free length $l$ of the sealing member 6 is in the range of 5 to 15 mm.

It is to be noted that according to this invention the photosensitive member may not always be drum-shaped but may also be in the shape of a belt. It should also be appreciated that although the membrane sealing member 6 of the sealing device of this invention has been employed in insulating film, an electroconductive film, rubber or metallic sheet and the like may also be used provided the elastic or resilient properties permit achieving the same effect. It should be understood from the foregoing description that since the sealing device of this invention is thus constructed and operated, the membrane sealing members 6 attached to the ends of the housings of the cleaning and developing units A and B, respectively, may approach the photosensitive member 1 sufficiently close that the developer will not be leaked out of the housings, and also that the photosensitive member 1 will not be scratched even for long-period usage. In addition, it should also be understood that the difficulties of the conventional sealing device using films attached to the entrance and the exit of the cleaning and developing units can be eliminated, and the membrane sealing member according to the invention can easily be employed.

What is claimed is:

1. In a xerographic copying machine of the type having a rotatable photosensitive member and cleaning and developing units in close proximity to said photosensitive member, a sealing device for sealing the gap between the photosensitive member and the housings of said cleaning and developing units, said sealing device comprising a membrane sealing member attached at one end to a respective one of said housings, the other end of said membrane sealing member resiliently contacting the periphery of said photosensitive member when said photosensitive member is at rest, said sealing member being positioned at a shallow angle of contact measured from a line parallel to the tangent to the periphery of said photosensitive member and being sufficiently flexible that air entrained by the rotation of the photosensitive member causes said sealing member to be floated from the surface of said photosensitive member.

2. The sealing device recited in claim 1 wherein said membrane sealing member is made of a polyester film.

3. The sealing device recited in claim 2 wherein said polyester film is approximately 5 to 20 microns in thickness and has a free length of approximately 5 to 15 mm.

4. The sealing device recited in claim 1 wherein said shallow angle is between approximately 15° and 30°.

* * * * *